US007512369B2

(12) United States Patent
Ishida et al.

(10) Patent No.: US 7,512,369 B2
(45) Date of Patent: Mar. 31, 2009

(54) FIXING DEVICE

(75) Inventors: Naoyuki Ishida, Osaka (JP); Hideki Kitagawa, Kadoma (JP); Akihiro Kondo, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 284 days.

(21) Appl. No.: 11/588,355

(22) Filed: Oct. 27, 2006

(65) Prior Publication Data

US 2007/0098466 A1 May 3, 2007

(30) Foreign Application Priority Data

Oct. 28, 2005 (JP) ..... 2005-314906

(51) Int. Cl.
*G03G 15/20* (2006.01)

(52) U.S. Cl. ..... 399/329

(58) Field of Classification Search ..... 399/329, 399/320; 219/216

See application file for complete search history.

(56) References Cited

U.S. PATENT DOCUMENTS 5,960,243 A * 9/1999 Daigo et al. ..... 399/329
6,459,877 B1 * 10/2002 Yoda et al. ..... 219/216
6,553,204 B1 * 4/2003 Yamada ..... 399/329
2007/0025784 A1 * 2/2007 Ito et al. ..... 399/329

FOREIGN PATENT DOCUMENTS

| | | |
|---|---|---|
| JP | 4-194887 | 7/1992 |
| JP | 11-38807 | 2/1999 |
| JP | 2000-150112 | 5/2000 |
| JP | 2001-343849 | 12/2001 |

* cited by examiner

*Primary Examiner*—Susan S Lee
(74) *Attorney, Agent, or Firm*—Smith, Gambrell & Russell, LLP

(57) ABSTRACT

A fixing device 6 according to the present invention has an endless-shaped heating belt 8, a first and a second roller 9 and 10 for stretching the heating belt 8, and a pressure roller 11 for nipping paper 2, together with the heating belt 8. The first roller 9 is supported so as to be rotatable by bearings 13 arranged at both ends of the first roller 9. The second roller 10 is supported so as to be rotatable by bearings 14 arranged at both ends of the second roller 10. The bearing 13 for supporting the first roller 9 is arranged more inward in an axial direction Z1 of the rollers than the bearing 14 for supporting the second roller 10.

5 Claims, 4 Drawing Sheets

FIXING DEVICE

BACKGROUND OF THE INVENTION

1. Field of the Invention

The present invention relates to a fixing device provided in an image forming apparatus such as a printer, a copying machine, or a facsimile.

2. Description of Related Art

Examples of a fixing device provided in an image forming apparatus include one comprising an endless-shaped heating belt and a pressure roller pressed against the heating belt. Paper on which a toner image has been transferred is nipped by the heating belt and the pressure roller, to be heated and pressurized. Thus, the toner image is fixed on the paper.

The heating belt is stretched between a pair of rollers spaced a predetermined distance apart from and arranged parallel to each other in the direction of movement of the heating belt, as disclosed in Japanese Unexamined Patent Publication No. 2000-150112, for example. Each of the pair of rollers is supported so as to be rotatable by bearings arranged at both ends of the roller.

In the above-mentioned fixing device, it is desired that the heating belt is raised to a predetermined temperature in a short time period and power consumption is low. Therefore, the heat capacity of the fixing device is reduced by thinning the heating belt or shortening the perimeter of the heating belt, for example.

In the above-mentioned configuration, however, the bearings respectively arranged at the ends on each side of the rollers are arranged at the same position in the axial direction of the rollers. Generally, the diameter of the bearings for supporting the roller is larger than the diameter of the roller, so that a predetermined distance at which the bearings do not interfere with each other must be ensured between the pair of rollers. Consequently, there is a limit to shorten the perimeter of the heating belt stretched between the pair of rollers by reducing the distance between the pair of rollers. Therefore, the heat capacity of the fixing device cannot be reduced.

SUMMARY OF THE INVENTION

The present invention has been made under such a background and has for its object to provide a fixing device in which the length of a heating belt is small and power consumption is low.

Another object of the present invention is to provide a compact (small-sized) fixing device using a belt.

In a fixing device that heats and pressurizes paper on which a toner image has been transferred to fix the toner image on the paper, the present invention is characterized in that bearings respectively arranged at ends on each side of a pair of rollers for stretching an endless-shaped heating belt are arranged so as to overlap with each other as viewed in the axial direction of the rollers and at different positions in the axial direction of the rollers.

According to this configuration, the bearings respectively arranged at the ends on each side of the rollers are arranged at different positions in the axial direction of the rollers. Therefore, the bearings do not interfere with each other, so that the distance between the axes of the rollers can be shortened. Consequently, the perimeter of the heating belt stretched between the pair of rollers can be shortened, so that the heat capacity of the fixing device can be reduced.

The bearings respectively arranged at the ends on each side are arranged so as to overlap with each other as viewed in the axial direction of the rollers, so that a gap between the rollers can be narrowed even if the diameter of the bearings is large.

Other features, elements, characteristics, and advantages of the present invention will become more apparent from the following description of preferred embodiments of the present invention with reference to the attached drawings.

DETAILED DESCRIPTION OF PREFERRED EMBODIMENTS

Figure 1:
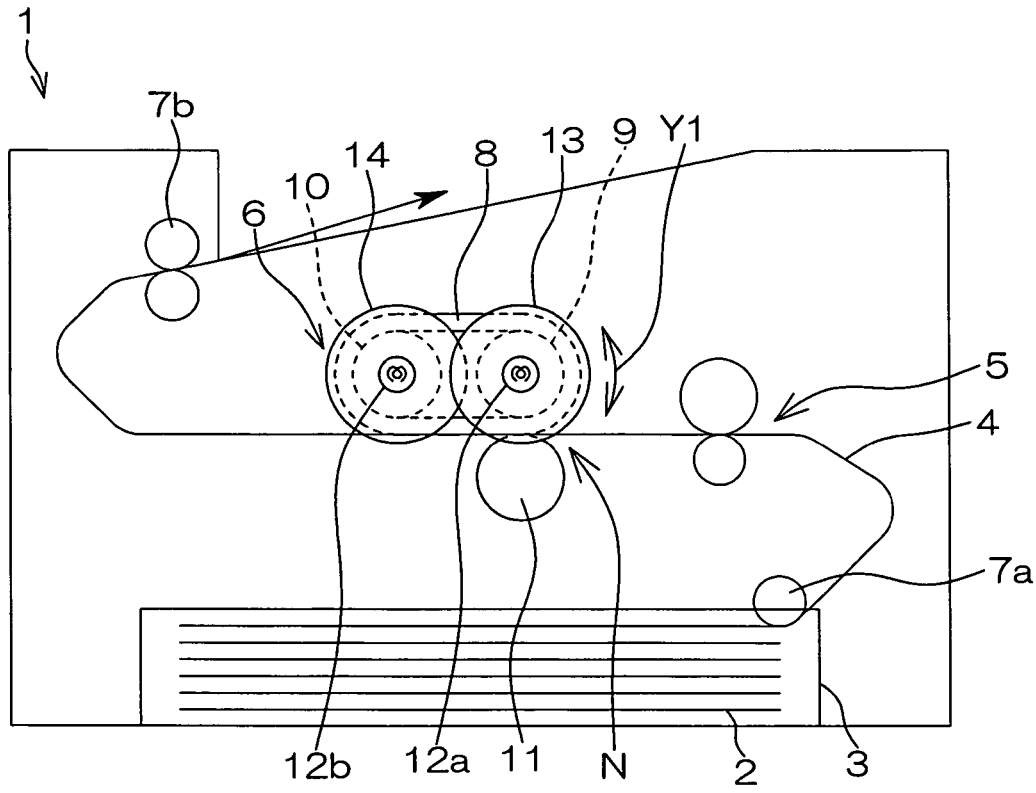
FIG. 1 is a schematic sectional view showing a schematic configuration of a printer serving as an image forming apparatus comprising a fixing device in an embodiment of the present invention.

Referring to the drawings, an embodiment of the present invention will be specifically described.

FIG. 1 is a schematic sectional view showing a schematic configuration of a printer 1 serving as an image forming apparatus comprising a fixing device 6 in the embodiment of the present invention. Referring to FIG. 1, the printer 1 comprises a cassette 3 containing paper 2, a paper feeding roller 7*a* for delivering the paper 2 to a paper conveying path 4 from the cassette 3, an image forming section 5 provided on the paper conveying path 4 for transferring a toner image on the paper 2, a fixing device 6 provided on the paper conveying path 4 for fixing the toner image that has been transferred on the paper 2, and a discharge roller 7*b* for discharging the paper 2 on which the toner image has been fixed from the printer.

Figure 2:
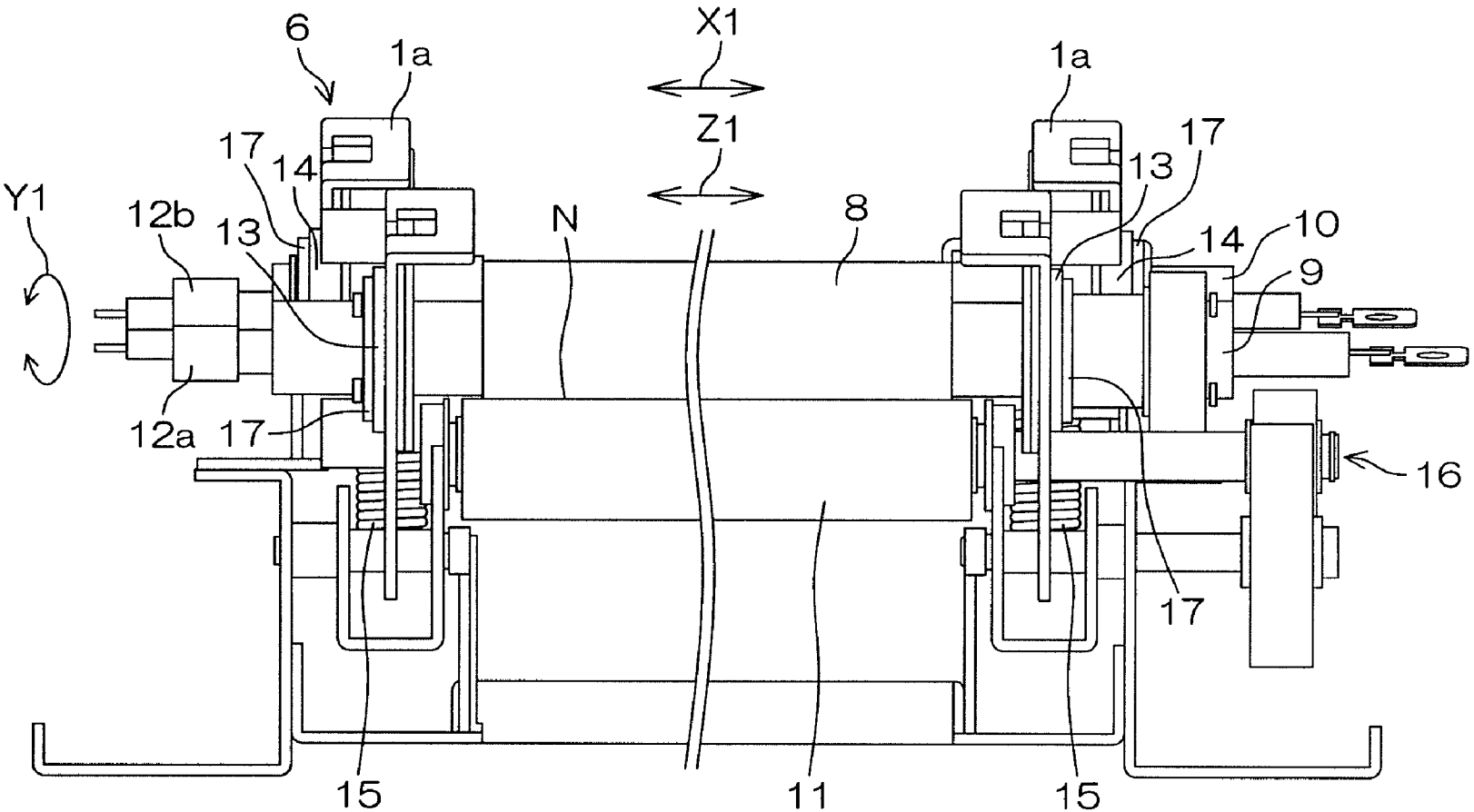
FIG. 2 is a front view of the fixing device in an embodiment of the present invention.
Figure 3:
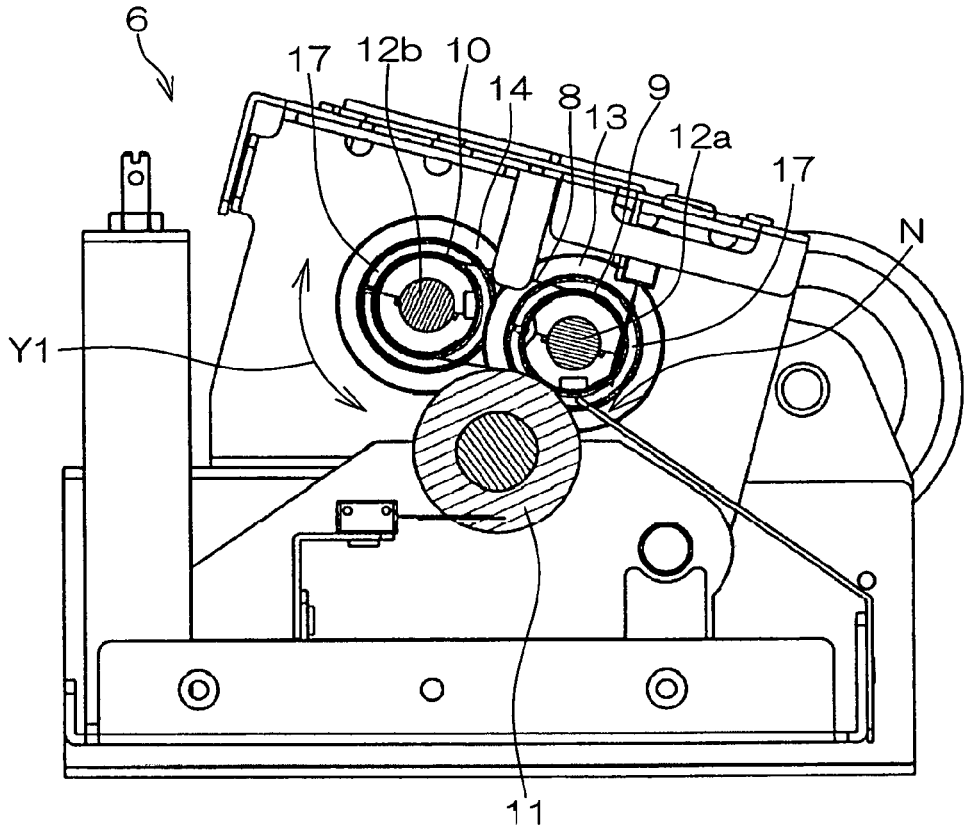
FIG. 3 is a transverse sectional view of the fixing device shown in FIG. 2.
Figure 4:
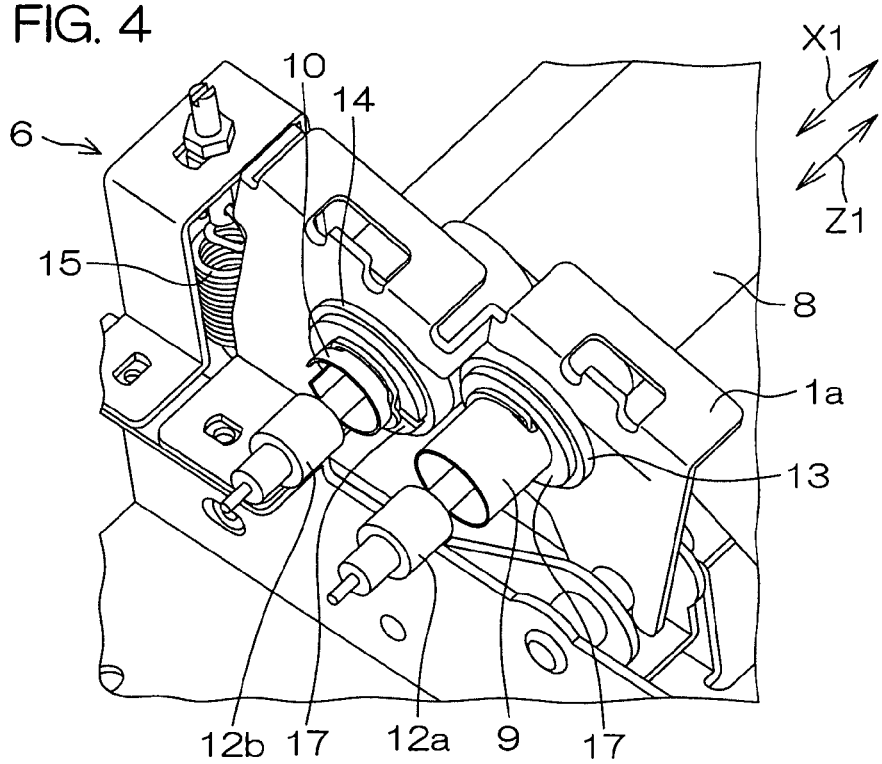
FIG. 4 is an enlarged perspective view on the left side of the fixing device shown in FIG. 2.
Figure 5:
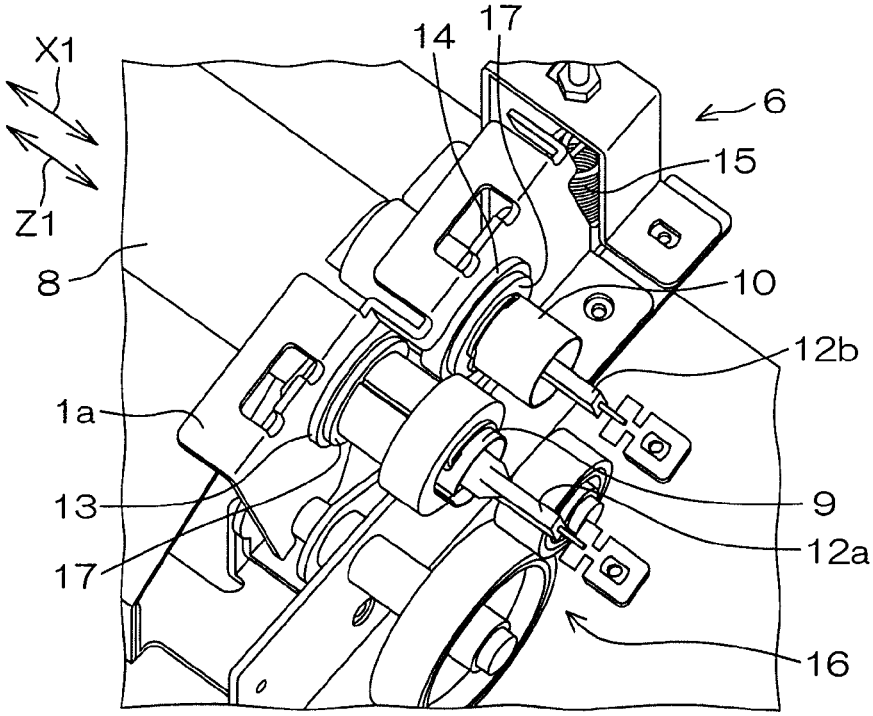
FIG. 5 is an enlarged perspective view on the right side of the fixing device shown in FIG. 2.

FIG. 2 is a front view of the fixing device 6 in an embodiment of the present invention, and FIG. 3 is a transverse sectional view of the fixing device 6 shown in FIG. 2. FIG. 4 is an enlarged perspective view on the left side of the fixing device 6 shown in FIG. 2, and FIG. 5 is an enlarged perspective view on the right side of the fixing device 6 shown in FIG. 2.

Referring to FIGS. 2 and 3, the fixing device 6 comprises an endless-shaped heating belt 8, a first and a second roller 9 and 10 for stretching the heating belt 8, and a pressure roller 11 for nipping the paper 2 together with the heating belt 8.

The endless-shaped heating belt 8 is formed of resin or metal, for example, and has a width larger than the width of the paper 2 in a direction X1 perpendicular to the direction of conveyance of the paper 2. In the present embodiment, the heating belt 8 is formed of stainless steel, and the wall thickness of the heating belt 8 is set to 0.44 mm.

The first and second rollers 9 and 10 are formed in a hollow cylindrical shape, and have a shaft length sufficiently larger than the width of the paper 2 in the direction X1 perpendicular to the direction of conveyance of the paper 2. Heat sources 12*a* and 12*b* extending in an axial direction Z1 of the rollers are respectively provided inside of the first and second rollers 9 and 10. In the present embodiment, the first and second rollers 9 and 10 are formed of iron, and the outer diameter and the wall thickness thereof are respectively set to $\phi$15.3 mm and 0.35 mm.

Bearings 13 held in frames 1*a* of the printer 1 are respectively arranged at both ends of the first roller 9. Bearings 14 held in the frames 1*a* of the printer 1 are respectively arranged at both ends of the second roller 10. A rolling bearing, for example, is used as the bearings 13 and 14. Outer rings of the bearings 13 and 14 are held in the frames 1*a*, and inner rings of the bearings 13 and 14 are respectively fitted in the outer peripheries of the first and second rollers 9 and 10 through insulating blushings 17. Consequently, the first roller 9 is supported by the bearings 13 so as to be rotatable, and the second roller 10 is supported by the bearings 14 so as to be rotatable. In the present embodiment, the outer diameter of the bearings 13 and 14 is set to ϕ26 mm.

The first and second rollers 9 and 10 are inserted into the heating belt 8, and are spaced a predetermined distance apart from and arranged parallel to each other in a circumferential direction Y1 of the heating belt 8. Thus, the heating belt 8 is stretched between the first and second rollers 9 and 10. The heating belt 8 is heated by the first and second rollers 9 and 10.

The pressure roller 11 is formed in a cylindrical shape, and has a shaft length larger than the width of the paper 2 in the direction X1 perpendicular to the direction of conveyance of the paper 2. The pressure roller 11 is pressed against at least either of the first and second rollers 9 and 10 through the heating belt 8 by an urging member 15 such as a spring, for example. In the present embodiment, the pressure roller 11 is pressed against the first roller 9 arranged on the carrying-in side of the paper 2 through the heating belt 8. Thus, a nip section N for nipping the paper 2 is formed between the heating belt 8 and the pressure roller 11.

The pressure roller 11 is connected to a driving mechanism 16 including a driving source (not shown). The pressure roller 11 is rotated by the driving mechanism 16, and the heating belt 8 and the first and second rollers 9 and 10 are driven and rotated as the pressure roller 11 is rotated. Thus, the paper 2 that has been conveyed to the nip section N is passed through the nip section N1.

The paper 2 on which the toner image has been transferred is heated and pressurized in the nip section N between the heating belt 8 and the pressure roller 11. The paper 2 on which the toner image has been transferred is passed through the nip section N by the rotation of the heating belt 8 and the pressure roller 11. Thus, the toner image is fixed on the paper 2.

Referring to FIGS. 4 and 5, the bearings 13 and 14 for respectively supporting the first and second rollers 9 and 10 are arranged at different positions so as not to overlap with each other in the axial direction Z1 of the rollers. Specifically, the bearing 13 for supporting the first roller 9 is arranged more inward than the bearing 14 for supporting the second roller 10 in the axial direction Z1 of the rollers. Even if the distance between the axes of the first and second rollers 9 and 10 is shortened, therefore, the bearings 13 and 14 do not interfere with each other, so that, as shown in FIG. 3, the bearings 13 and 14 are arranged so as to overlap with each other, when viewed in the axial direction Z1 of the rollers (in a direction perpendicular to paper in FIG. 3). In the present embodiment, the distance between the first roller 9 and the bearing 14 and the distance between the second roller 10 and the bearing 13 are set to approximately 1.8 mm.

The bearings 13 and 14 are arranged so as to be bilaterally symmetrical in the axial direction Z1 of the rollers, as shown in FIG. 2. The first roller 9 is provided closer to the carrying-in side of the paper 2 than the second roller 10 (front of the second roller 10 in FIG. 2).

As described in the foregoing, according to the present embodiment, the bearing 13 for supporting the first roller 9 is arranged more inward than the bearing 14 for supporting the second roller 10 in the axial direction Z1 of the rollers. Thus, the bearings 13 and 14 do not interfere with each other, so that the distance between the axes of the first and second rollers 9 and 10 can be shortened than that in a case where the bearings 13 and 14 are arranged at the same position in the axial direction Z1 of the rollers. Consequently, the perimeter of the heating belt 8 stretched between the first and second rollers 9 and 10 can be shortened. As a result, the fixing device 6 can be miniaturized to reduce the heat capacity of the fixing device 6.

Furthermore, the bearings 13 and 14 are arranged so as to be bilaterally symmetrical in the axial direction Z1 of the rollers, so that the first and second rollers 9 and 10 can be stably rotated. Consequently, the heating belt 8 is prevented from meandering so that the paper 2 can be stably conveyed.

The present invention is not limited to the contents of the above-mentioned embodiment. Various changes can be made within the scope of claims. Although an example in which the rolling bearing is used as the bearings 13 and 14 has been described in the above-mentioned embodiment, a sliding bearing may be used as the bearings 13 and 14.

Although an example in which the bearing 13 for supporting the first roller 9 is arranged more inward than the bearing 14 for supporting the second roller 10 in the axial direction Z1 of the rollers has been described in the above-mentioned embodiment, the bearing 13 may be arranged more outward than the bearing 14 in the axial direction Z1 of the rollers. The bearings 13 and 14 may be alternately arranged.

Although an example in which the heat sources 12*a* and 12*b* are respectively arranged inside of both the first and second rollers 9 and 10 has been described in the above-mentioned embodiment, the heat source may be arranged inside of at least either of the first and second rollers 9 and 10.

Although an example in which the image forming apparatus is a printer has been described in the above-mentioned embodiment, the image forming apparatus may be a copying machine or a facsimile. Further, the image forming apparatus may be a multi-functional machine having the functions of two or more of the printer, the copying machine, and the facsimile.

The present application corresponds to an Application No. 2005-314906 filed with the Japanese Patent Office on Oct. 28, 2005, the disclosure of which is hereinto incorporated by reference.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A fixing device that heats and pressurizes paper on which a toner image has been transferred to fix the toner image on the paper, comprising:

an endless-shaped heating belt;

a pair of rollers spaced a predetermined distance apart from and arranged parallel to each other in the direction of movement of the heating belt for stretching the heating belt;

bearings arranged at both ends of each of the rollers for supporting the rollers so as to be rotatable; and a pressure member for nipping the paper together with the heating belt, wherein the bearings respectively arranged at the ends on each side of the rollers are arranged so as to overlap with each other as viewed in the axial direction of the rollers and at different positions in the axial direction of the rollers.

2. The fixing device according to claim 1, wherein the diameter of the bearings is larger than the diameter of the roller supported thereby.

3. The fixing device according to claim 1, wherein the bearings are fitted in the outer periphery of the roller supported thereby.

4. The fixing device according to claim 1, wherein the bearings arranged at both ends of one of the pair of rollers are respectively arranged more inward than the bearings arranged at both ends of the other roller in the axial direction of the rollers.

5. The fixing device according to claim 4, wherein the roller having the bearings arranged more inward is provided on the carrying-in side of the paper.

* * * * *